US010087592B2

(12) United States Patent
Schaedler

(10) Patent No.: US 10,087,592 B2
(45) Date of Patent: Oct. 2, 2018

(54) SNOW THROWER HAVING A MULTIPLE SPEED IMPELLER

(71) Applicant: MTD PRODUCTS INC, Valley City, OH (US)

(72) Inventor: Axel Schaedler, Olmstead Township, OH (US)

(73) Assignee: MTD PRODUCTS INC, Valley City, OH (US)

( * ) Notice: Subject to any disclaimer, the term of this patent is extended or adjusted under 35 U.S.C. 154(b) by 181 days.

(21) Appl. No.: 15/179,361

(22) Filed: Jun. 10, 2016

(65) Prior Publication Data

US 2016/0362859 A1 Dec. 15, 2016

Related U.S. Application Data

(60) Provisional application No. 62/174,736, filed on Jun. 12, 2015.

(51) Int. Cl.
*E01H 5/09* (2006.01)
*E01H 5/04* (2006.01)

(52) U.S. Cl.
CPC ..... *E01H 5/098* (2013.01); *E01H 5/045* (2013.01); *E01H 5/09* (2013.01); *E01H 5/096* (2013.01)

(58) Field of Classification Search
CPC ..... E01H 5/098; E01H 5/045; E01H 5/09; E01H 5/096; F16H 9/04; F16H 7/0827; F16H 2009/163; F16H 3/72; A01B 71/06
See application file for complete search history.

(56) References Cited

U.S. PATENT DOCUMENTS 674,794 A * 5/1901 Capel ..... F16H 9/04 474/5
2,445,797 A * 7/1948 Moore ..... F16H 7/0827 180/19.1
2,566,177 A * 8/1951 Eustis ..... F16H 3/00 474/117
2,878,690 A * 3/1959 Uher ..... F16H 48/12 180/366

(Continued)

FOREIGN PATENT DOCUMENTS

DE 938 193 C 1/1956
EP 2 080 835 7/2009

OTHER PUBLICATIONS

International Search Report and Written Opinion for International Application No. PCT/US2016/035942 dated Oct. 10, 2016.

*Primary Examiner* — Jamie L McGowan
(74) *Attorney, Agent, or Firm* — Wegman, Hessler & Vanderburg

(57) ABSTRACT

A snow thrower having a power supply with a crankshaft operatively connected thereto is provided. The snow thrower further includes an impeller operatively connected to a first drive shaft. A first drive train operatively connects the crankshaft to the first drive shaft to provide a first rotational speed of the first drive shaft and impeller. An impeller speed adjustment assembly includes a second drive train that operatively connects the crankshaft to the first drive shaft to provide a second rotational speed of the first drive shaft and impeller therebetween, wherein the first and second rotational speeds of the first drive shaft and impeller are different.

17 Claims, 9 Drawing Sheets

(56) References Cited

U.S. PATENT DOCUMENTS 2,927,480 A * 3/1960 Schweickart ..... B60K 17/16 180/218
3,091,132 A * 5/1963 Mayfield ..... F16H 37/0846 474/32
3,938,400 A * 2/1976 Konyha ..... B62D 51/001 180/6.66
4,063,609 A * 12/1977 Kincaid ..... B60K 17/16 180/246
4,457,086 A * 7/1984 Bacon ..... E01H 5/04 192/3.54
4,476,743 A * 10/1984 Magin ..... A01B 71/06 192/20
4,504,247 A * 3/1985 Chana ..... F16H 63/062 474/17
4,514,917 A * 5/1985 Ogano ..... B60K 17/04 192/3.54
4,577,712 A * 3/1986 Foote ..... B62K 5/01 180/53.1
4,712,453 A * 12/1987 Haley ..... B60W 10/02 477/163
4,726,256 A * 2/1988 von Kaler ..... F16H 3/72 475/160
4,897,942 A * 2/1990 Klas ..... E01H 5/04 37/244
5,018,592 A * 5/1991 Buchdrucker ..... B62D 11/08 180/19.3
5,090,142 A * 2/1992 Peters ..... A01D 42/08 239/663
5,393,270 A * 2/1995 Grobbelaar ..... F16H 7/0827 474/5
5,603,173 A 2/1997 Brazell
6,318,003 B1 11/2001 Heismann
6,327,798 B1 12/2001 Sakai et al.
6,651,529 B1 * 11/2003 Poplawsli ..... B60K 17/10 180/348
7,134,278 B2 * 11/2006 Sakikawa ..... A01D 69/03 60/484
7,730,642 B2 6/2010 Sugiura
8,182,380 B2 * 5/2012 Kohigashi ..... F16H 37/027 474/5
8,230,761 B2 * 7/2012 Takashina ..... F02B 67/06 180/364
8,281,914 B2 10/2012 Wians et al.
8,327,972 B1 * 12/2012 Schneider ..... F16H 7/023 180/443
8,863,485 B2 * 10/2014 Pitcel ..... A01D 69/025 56/10.2 R
8,900,080 B2 * 12/2014 Kawasaki ..... B60K 6/48 475/210
8,974,337 B2 * 3/2015 Kawasaki ..... B60K 6/445 475/5
2002/0170209 A1 11/2002 Ruebusch et al.
2003/0046834 A1 3/2003 Hanafusa et al.
2009/0205226 A1 8/2009 Olmr et al.
2015/0007461 A1 1/2015 Schmalz

* cited by examiner

SNOW THROWER HAVING A MULTIPLE SPEED IMPELLER

FIELD OF THE INVENTION

The present invention is directed to snow removal devices, and more particularly, to a snow thrower having an operator-selectable multiple speed impeller for throwing snow at different speeds from a chute.

BACKGROUND OF THE INVENTION

Snow removal machines typically include housings with a forward opening through which material enters the machine. At least one rotatable member (auger) is typically positioned and rotatably secured within the housing for engaging and eliminating the snow from within the housing. Snow blower technology is generally focused on (1) a single-stage mechanisms in which rotation of augers, flights, or brushes contact and expel, or throw, the snow in a single motion, or (2) a two-stage mechanism in which rotation of augers move loosened snow toward a separate impeller that expels, or throws, the snow. Impellers are usually devices such as discs and blades that are shaped and configured such that when rotated they receive materials (snow) and then centrifugally discharge the materials through openings in the housings and then into chutes that control and direct the materials. Both the single- and two-stage snow throwers often require significant force to move the snow thrower forward through the snow unless the snow thrower includes a transmission to drive the snow thrower. This resulting forward movement pushes, or otherwise compacts, the snow into the housing if driven forwardly at a pace that is too quick. When this happens, the single- and two-stage snow throwers often bog down or become overburdened due to snow accumulation within the housing.

Typical two-stage, three-stage, and more, snow throwers utilize an impeller for expelling snow from a housing, wherein the impeller rotates at a continuous rotational velocity such that the distance that the snow is thrown from the snow thrower is substantially constant within each use (understanding that the characteristics of the accumulated snow after each snowfall is often different, such as a "heavier" or "wetter" snow or the like). When snow throwers are used between walls of adjacent buildings or between adjacent structures, the chute of the snow thrower is often directed forwardly (in the direction of travel) to avoid throwing snow onto either of the adjacent structures. However, when the chute is directed forwardly, this results in snow being required to be removed—or thrown—multiple times before it is finally thrown off of the surface being cleared. This re-circulation of thrown snow repeatedly increases the load on the engine as the thrown snow often lands on top of the accumulated snow, thereby doubling (or more) the depth of the snow needing to be cleared.

BRIEF SUMMARY OF THE INVENTION

According to one aspect of the present invention, a snow thrower is provided. The snow thrower an impeller operatively connected to a first drive shaft. A first drive train extends between the first drive shaft and a crankshaft operatively connected to a power supply for selectively driving the first drive shaft at a first rotational speed in response to rotation of the crankshaft. At least one secondary drive train extends between the first drive shaft and the crankshaft, wherein each of the secondary drive trains selectively drives the first drive shaft at a rotational speed different than the first rotational speed. An operator control mechanism is operatively connected to the one secondary drive trains. The operator control mechanism is actuatable between a first operative position and at least one second operative position, wherein the first drive train drives the first drive shaft at the first rotational speed when the operator control mechanism is in the first operative position and one of said secondary drive trains drives the first drive shaft at a second rotational speed when the operator control mechanism is in another operative position.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1A:
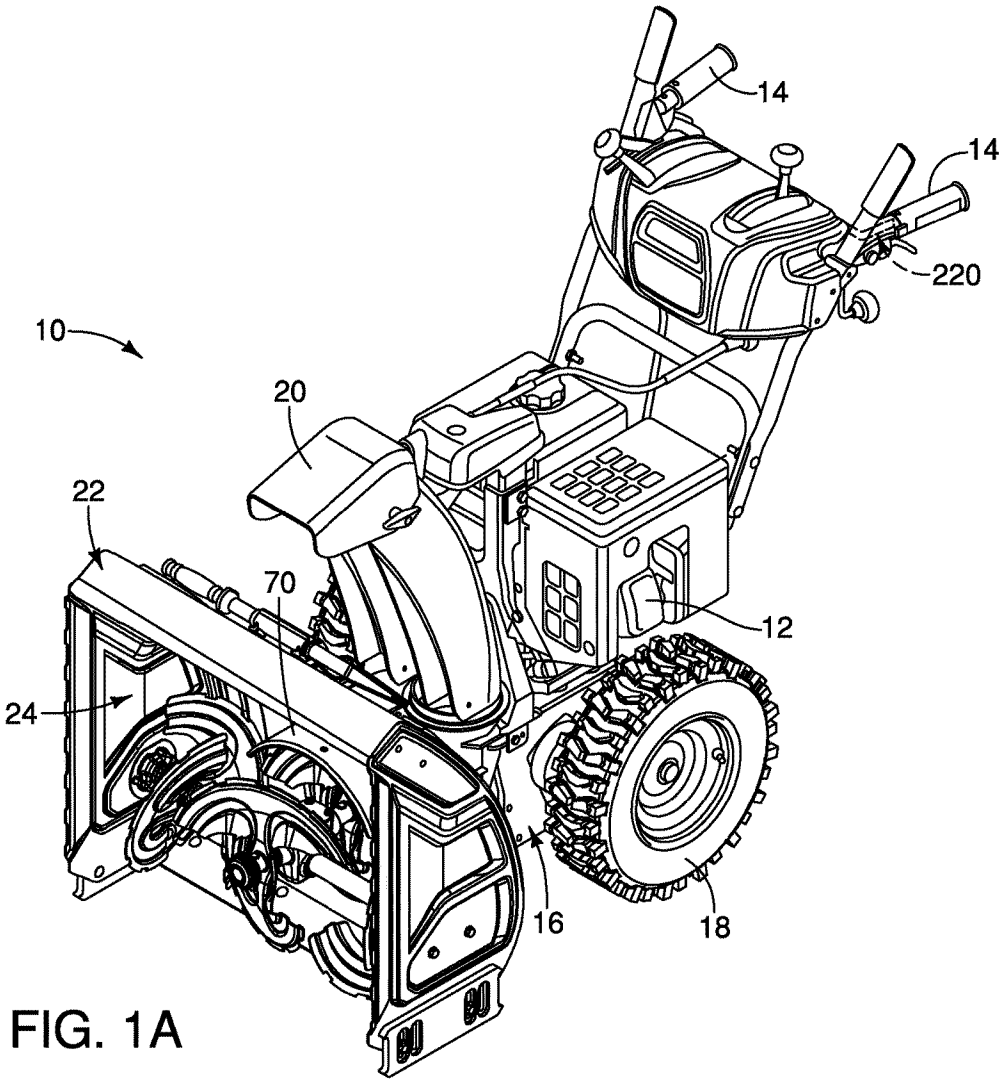
FIG. 1A is top perspective view of a portion of a multiple-stage snow thrower.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Referring to FIG. 1A, an exemplary embodiment of a multiple-stage snow thrower 10 is shown. In the illustrated embodiment, the snow thrower 10 includes a power supply 12 configured to provide power, either directly or indirectly, to drive each of the separate stages to remove and expel or throw accumulated snow from concrete, pavement, driveways, sidewalks, and the like. The power supply 12 is shown as an internal combustion engine, but it should be understood by one of ordinary skill in the art that the multiple-stage snow thrower 10 may alternatively be corded to receive electrical power, include a rechargeable battery, be a hybrid gas/electric power, or any other commonly known power supplies. The snow thrower 10 also includes a pair of graspable handles 14 extending from a frame 16, wherein the handles 14 are used by an operator to control the direction and movement of the snow thrower 10. The snow thrower 10 may also include tracks or a pair of wheels 18 for allowing the snow thrower to roll along the ground while removing accumulated snow. The tracks or wheels 18, in some embodiments, are driven by a transmission powered by the power supply 12 and attached to a frame 16. The snow thrower 10 is configured to remove piled-up snow and propel, or throw the snow to a different location via a chute 20 that is operatively connected to the frame 16 into which the piled-up snow enters the snow thrower 10.

Figure 1B:
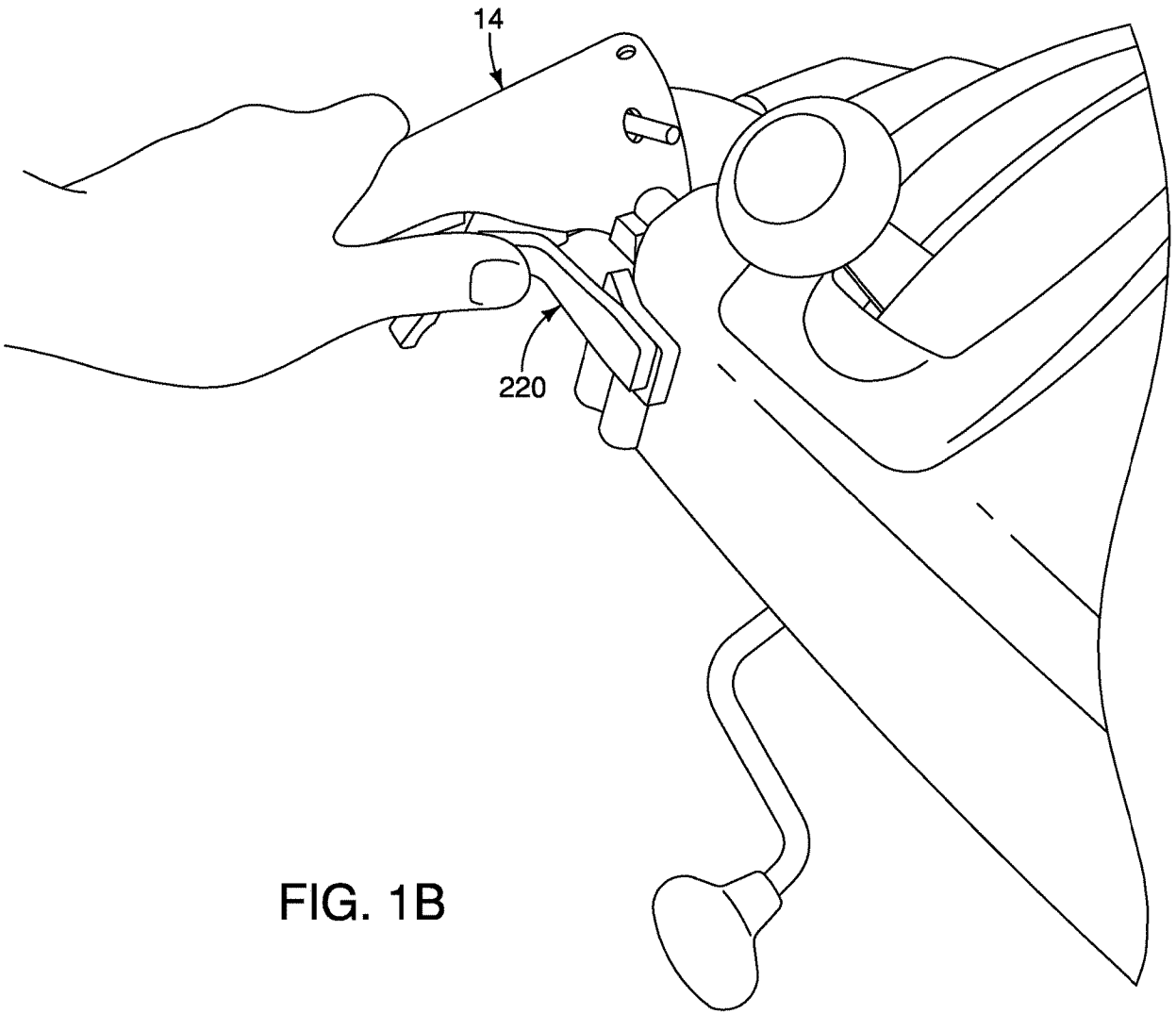
FIG. 1B is a top perspective view of the multiple-stage snow thrower having an impeller speed adjustment assembly operatively connected thereto.
Figure 2:
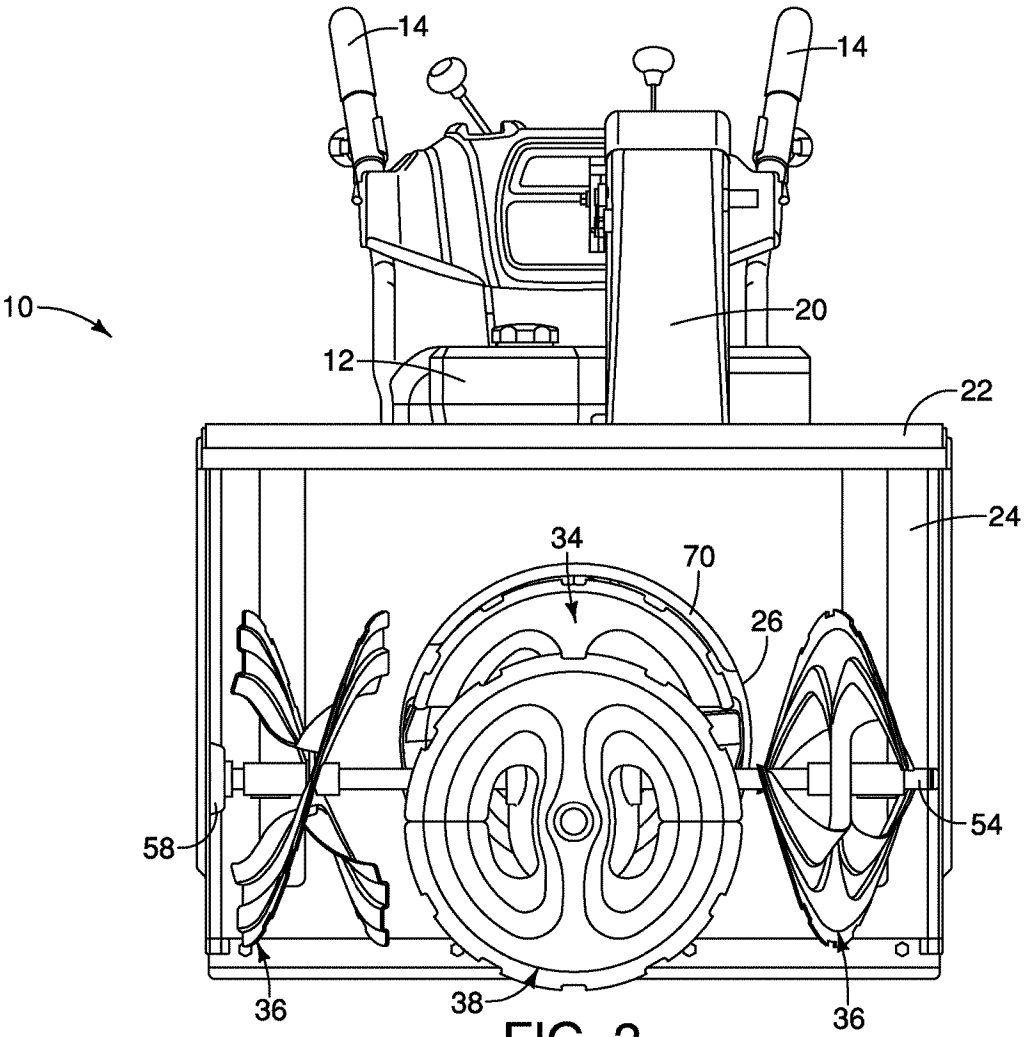
FIG. 2 is a front view of the snow thrower shown in FIG. 1A.

The snow thrower 10 includes a housing 22 that is operatively connected to the frame 16 and is formed as a generally semi-cylindrical shape, or C-shaped, as shown in FIGS. 1A-2. The housing 22 includes a recess 24 that extends rearwardly from the central C-shaped portion. The housing 22 is laterally oriented with respect to the longitudinal axis and fore/aft movement of the snow thrower 10. The housing 22 is formed of a metal or other material having sufficient strength to withstand lower temperatures as well as the repeated impact of snow and debris during operation of the snow thrower 10. The housing 22 further includes a forwardly-directed opening into which snow enters the housing 22 and rearwardly-directed outlet aperture 26 through which the snow is transferred out of the housing 22 by the first, second, third, and fourth stages of the snow thrower 10, as will be described below. The housing 22 includes the main chamber as well as an expulsion housing 29 (FIG. 4) that is extends from the rear wall of the main chamber such that the expulsion housing 29 extends rearwardly and is fluidly connected with the main chamber through the outlet aperture 26.

In the embodiment illustrated in FIGS. 3A-3B, 4, and 5A-5B, the power supply 12 is operatively connected to a first drive shaft 28 that extends into the housing 22 for providing rotational power to each of the stages of the snow thrower 10 that are interconnected therewith. The power supply 12 selectively drives or rotates the first drive shaft 28, wherein the power supply 12 can cause the first drive shaft 28 to always rotate when the power supply 12 is active, or the operator can selectively determine when the power supply 12 engages or otherwise causes the first drive shaft 28 to rotate. One distal end of the first drive shaft 28 is external to the housing 22 and the opposing distal end of the first drive shaft 28 terminates within, or adjacent to, the gear housing 30. In another embodiment, the first drive shaft 28 may extend longitudinally through the gear housing 30. The first drive shaft 28 is aligned such that the longitudinal axis thereof is substantially aligned with the fore/aft direction and centerline of the multiple-stage snow thrower 10.

The first drive shaft 28 is configured to directly or indirectly drive the first stage assembly 32, the second stage assembly 34, the third stage assembly 36, and a fourth stage assembly 38, wherein rotation of these assemblies cuts through the accumulated snow as well as moves the snow within the housing 22 toward the outlet aperture 26 for expulsion from the housing 22. In other embodiments, the first drive shaft 28 is configured to directly or indirectly drive any number of the first, second, third, and fourth stage assemblies 32, 34, 36, 38, wherein those stage assemblies that are not driven by the drive shaft 28 are driven separately. For example, the first drive shaft 28 can be configured to drive the first, second, and third stage assemblies 32, 34, 36, and the fourth stage assembly 38 is driven by an electric motor or other drive shaft operatively connected to the power source 12. It should be understood by one having ordinary skill in the art that these are only exemplary driven power arrangements and that other alternative driven power divisions and arrangements are contemplated as well.

Figure 3A:
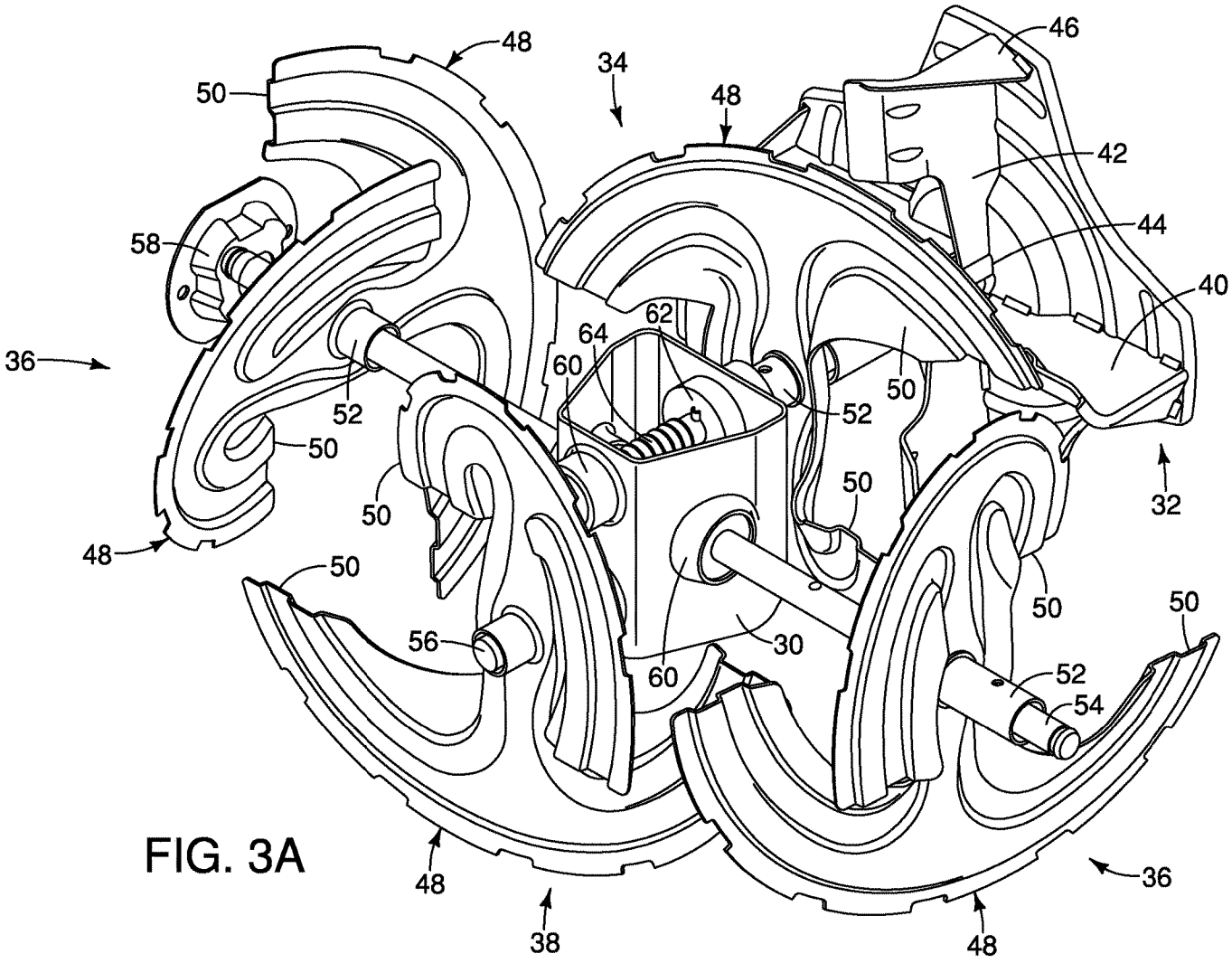
FIG. 3A is a top perspective view of the first, second, third, and fourth stage assemblies.
Figure 3B:
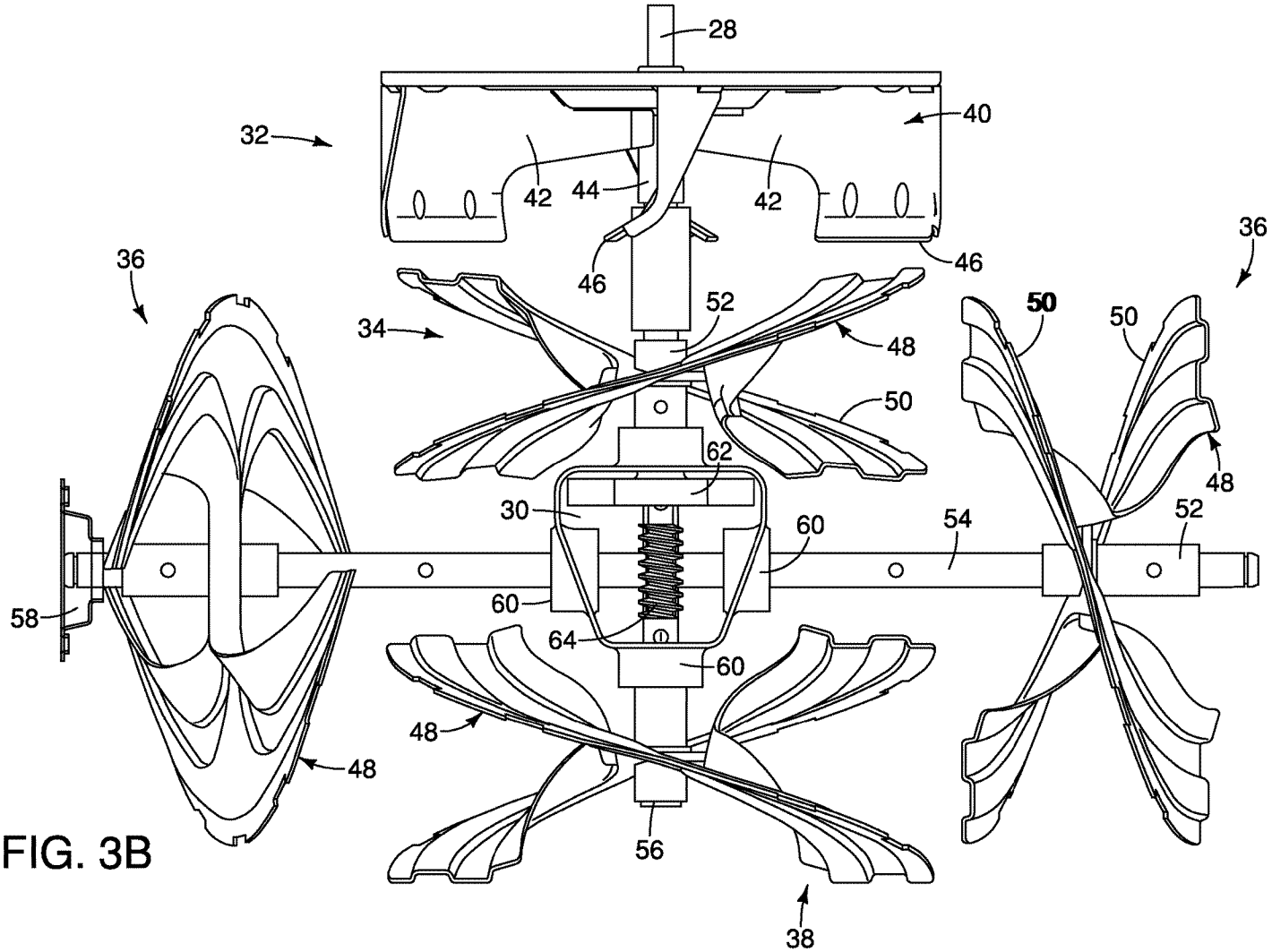
FIG. 3B is a top view of the first, second, third, and fourth stage assemblies.
Figure 4:
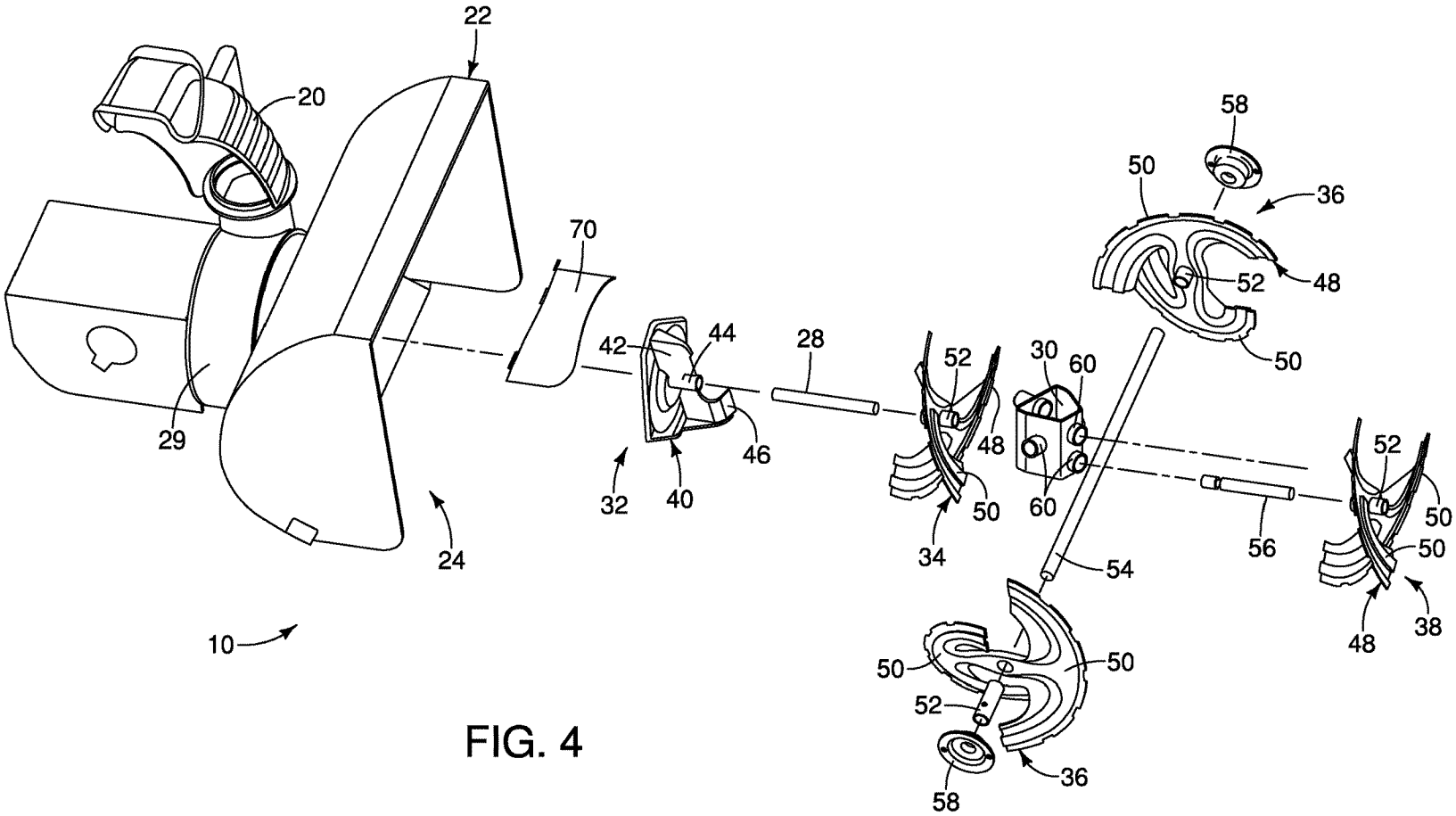
FIG. 4 is an exploded view of the snow thrower.

As shown in FIGS. 3A-3B and 4, the first stage assembly 32 is operatively connected to the first drive shaft 28. The first stage assembly 32 is configured to expel accumulated snow and ice—via the chute 20—that is moved into contact with the first stage assembly 32 within the housing 22. In an embodiment, the first stage assembly 32 is formed as a rotatable impeller 40, wherein the impeller 40 is positioned within the expulsion housing 29 that extends rearwardly from the main chamber of the housing 22. The impeller 40 is positioned between the power supply 12 and the gear housing 30. The impeller 40 is configured to receive the snow from the third stage assembly 34, and through rotation of the impeller 40 about the longitudinal axis defined by the first drive shaft 28 at a sufficient rotational velocity to centrifugally throw or otherwise expel the snow through the chute 20 and away from the snow thrower 10. The impeller 40 is removably attached to the first drive shaft 28 to allow removal and/or replacement of the impeller 40. The impeller 40 can be attached to the first drive shaft 28 using any attachment mechanism such as nut-and-bolt, cotter pin, or the like.

As shown in FIGS. 3A-3B and 4, an exemplary embodiment of an impeller 40 includes a plurality of blades 42 that extend radially outwardly from a base 52, wherein the impeller 40 is attached to the first drive shaft 28 by sliding the base 52 over the outer surface of the first drive shaft 28 and secured thereto. In an embodiment, each blade 42 includes a tip 46 that extends from the end of the blade 42 in a curved manner. The tips 46 are curved in the direction of rotation of the impeller 40. The curved tips 46 assist in maintaining contact between the snow and the blades 42 as the impeller 40 rotates, thereby preventing the snow from sliding past the ends of the blades 42 to the gap between the blades 42 and the inner surface of the expulsion housing 29 before the snow is thrown into and from the chute 20. Preventing the snow from sliding past the end of the blades 42 results in less re-circulation of the snow within the expulsion housing 29, thereby making the snow thrower 10 more efficient in expelling the snow. Whereas the augers of the first, second, and third stage assemblies are configured to push snow axially along the axis of rotation of each respective auger, the impeller 40 is configured to drive or throw snow in a radial direction away from the axis of rotation of the impeller 40.

In the embodiment illustrated in FIGS. 3A-3B and 4, the second stage assembly 34 is operatively connected to the first drive shaft 28 and is located upstream relative to the first stage assembly 32. The second stage assembly 34 is positioned between the first stage assembly 32 and the gear housing 30 and is configured to push or otherwise move snow and ice rearward toward the first stage assembly 32 within the housing 22 to allow the snow and ice to be expelled from the housing 22. The second stage assembly 34 is configured to move snow and ice within the housing 22 in a generally rearward direction (relative to the fore/aft direction of movement of the snow thrower 10), thereby moving snow from the front portion of the housing 22 to the rear of the housing 22. The second stage assembly 34 is configured to be releasably connected to the first drive shaft 28 to allow the second stage assembly 34 to be removed and/or replaced easily. In the illustrated embodiment, the first stage assembly 32 and the second stage assembly 34 rotate at the same rotational velocity because they are both secured to the first drive shaft 28. It should be understood by one having ordinary skill in the art that the first and second stage assemblies 32, 34 may be connected to separate concentrically-oriented drive shafts driven by the power supply, wherein each stage assembly may rotate at a rotational velocity that is different from the other stage assembly.

In an exemplary embodiment, the second stage assembly 34 is formed of a single auger 48. In other embodiments, the second stage assembly 34 includes a plurality of augers 48, wherein each auger 48 is positioned between the first stage assembly 32 and the gear housing 30. It should be understood by one having ordinary skill in the art that the second stage assembly 34 can include any number of augers 48. In some embodiments, the impeller 40 of the first stage assembly 32 and the auger(s) 48 of the second stage assembly 34 are configured to rotate at the same rotational speed. In other embodiments, the impeller 40 of the first stage assembly 32 and the auger(s) 48 of the second stage assembly 34 are configured to rotate ad different rotational speeds. In some embodiments, rotation of the second stage assembly 34 is dependent upon rotation of the first stage assembly 32. In other embodiments, the second stage assembly 34 rotates independently relative to the first stage assembly 32.

Each auger 48 includes at least one flight 50 that extends radially outward from a base 52 as well as extending at least somewhat concentrically with the outer surface of the base 52. In the illustrated embodiment, the flights 50 include a base portion that extends radially from the base 52 in a generally linear manner, and an arc-shaped blade portion that expands from the end of the base portion in a generally semi-circular manner about the base 52. The blade portion of the flight 50 is also curved, or angled in a helical manner about the base 52. The blade portion of each flight 50 extends about the base 52 about one hundred eighty degrees (180°) such that two flights 50 extending about the entire periphery of the base 52. In another embodiment, each auger 48 has a single flight 50 that extends helically about the entire periphery of the base 52 in a helical manner. In yet another embodiment, each auger 48 includes more than two flights 50 extending from the base 52 such that all of the flights 50 extend about at least the entire periphery of the base 52. The augers 48 can be formed of segmented or continuous flights 50, or the augers 48 may include brushes incorporated with the flights 50. The augers 48 illustrated are for exemplary purposes, and it should be understood by one having ordinary skill in the art that the augers 48 can be formed in any manner that allows each auger 48 to push snow in a direction generally parallel to the axis of rotation of the auger 48. In other embodiments, the augers 48 are configured in a corkscrew or spiral shape. In operation, the second stage assembly 34 is configure to rotate and push or transport the snow in a direction generally parallel to longitudinal axis of the first drive shaft 28. In embodiments in which the first and second stage assemblies 32, 34 are both attached to the first drive shaft 28, the first and second stage assemblies 32, 34 rotate about a common axis.

In the embodiment of the snow thrower 10 illustrated in FIGS. 3A-3B, 4, and 5A-5B, the first stage assembly 32 and the second stage assembly 34 are operatively connected to the first drive shaft 28. The first drive shaft 28 terminates within or extending through the gear housing 30. The gear housing 30 is a generally rectangular hollow member configured to provide a structural support for receiving the longitudinally-aligned first drive shaft 28, the laterally-aligned second drive shaft 54, and the longitudinally-aligned third drive shaft 56, wherein the transfer of rotational power between the first drive shaft 28, the second drive shaft 54, and the third drive shaft 56 is accomplished within the walls of the gear housing 30. In an embodiment, the gear housing 30 is a fully enclosed member to prevent dirt, debris, or fluids from entering and interfering with the transfer or rotational power between the first, second, and third drive shafts 28, 54, 56. In another embodiment, the gear housing 30 is a generally tubular member having an opening at the top and/or bottom thereof. In an embodiment, the gear housing 30 is formed of a casting, but it should be understood by one having ordinary skill in the art that the gear housing may also be formed of formed metal sheets welded together or any other method of manufacturing a structurally rigid material. The gear housing 30 includes a plurality of bosses 60, wherein each boss 60 is configured to receive a bearing 58 to support the first, second, and third drive shafts 28, 54, 56.

Figure 5B:
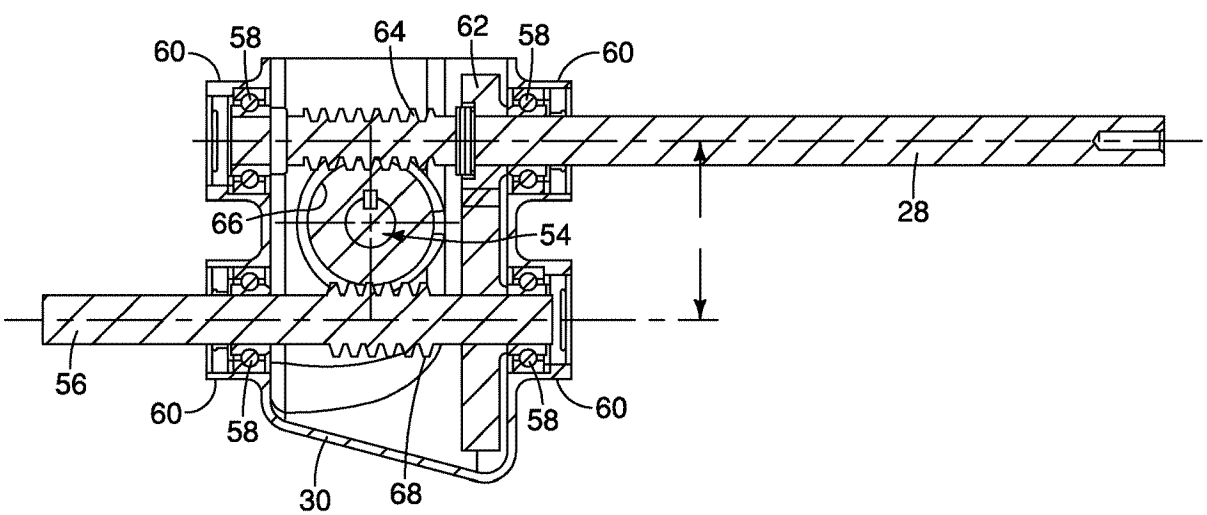
FIG. 5B is a cross-sectional side view of the gear housing and the components located therein.
Figure 5A:
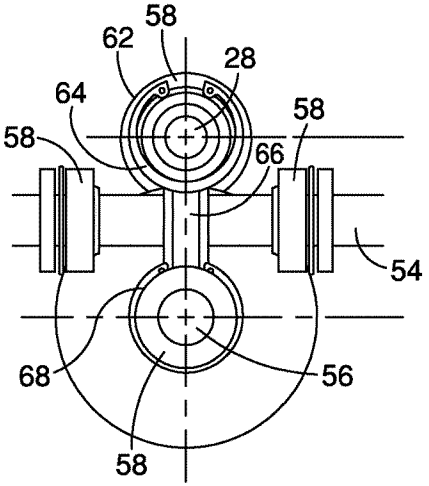
FIG. 5A is a front view of the components located within the gear housing.

In an embodiment, the first drive shaft 28 extends into the gear housing 30, wherein the gear housing 30 includes a first bearing 58 located within the boss 60 located at a downstream position on the first drive shaft 28 and a second bearing 58 is located within the boss 60 that supports the distal end of the first drive shaft 28, as shown in FIGS. 5A-5B. In a similar manner, the gear housing 30 further includes a bearing 58 positioned within a boss 60 at each location of the gear housing 30 through which the second drive shaft 54 enters the gear housing 30. The gear housing 30 also includes a first bearing 58 located within the boss 60 located at an upstream position on the third drive shaft 56 and a second bearing 58 is located within the boss 60 that supports the distal end of the third drive shaft 56. In an embodiment, each of the bearings 58 is formed as the same type of bearing. In the exemplary embodiment, the bearings 58 are formed as ball bearings, but it should be understood by one having ordinary skill in the art that any type of bearing can be used.

The first drive shaft 28 includes a pair of power transfer mechanisms attached thereto, wherein the power transfer mechanisms are configured to transfer rotational power and rotation from the first drive shaft 28 to the second and third drive shafts 54, 56, as shown in FIGS. 3A-3B and 5A-5B. The first transfer mechanism 62 of the first drive shaft 28 is positioned adjacent to the first bearing 58 and the inner surface of the gear housing 30, downstream from the second bearing 58. In the exemplary embodiment, the first transfer mechanism 62 is formed as a pinion gear, wherein the pinion gear includes a plurality of gear teeth directed radially outward and positioned about the circumference of the pinion gear. It should be understood by one having ordinary skill in the art that although the first transfer mechanism 62 is shown as a pinion gear, the first power transfer mechanism 62 can be formed as any other type of mechanical component capable of transferring rotational power and rotation from the first drive shaft 28 to the third drive shaft 56 such as a spiral gear, a bevel gear, a spur gear, a worm gear, a planetary gear, or the like. In an embodiment, the first power transfer mechanism 62 is formed separately from the first drive shaft 28 and subsequently attached thereto. In another embodiment, the first power transfer mechanism 62 is integrally formed with the first drive shaft 28 simultaneously with the formation of the first drive shaft 28. In yet another embodiment, the first power transfer mechanism 62 is formed into the first drive shaft 28 after the first drive shaft 28 is manufactured.

The second power transfer mechanism 64 of the first drive shaft 28 is positioned between the first power transfer mechanism 62 and the distal end of the first drive shaft 28, as shown in FIGS. 4A-4B and 5A-5B. In an embodiment, the second power transfer mechanism 64 is formed as a worm gear formed into the outer surface of the first drive shaft 28. The worm gear includes a plurality of helically-shaped ribs positioned on the outer surface of the first drive shaft 28, wherein the ribs are configured to provide meshing engagement with a corresponding power transfer mechanism. It should be understood by one having ordinary skill in the art that the second power transfer mechanism 64 can be formed as any other type of mechanical component capable of transferring rotational power and rotation from the first drive shaft 28 to the second drive shaft 54 such as a spiral gear, a bevel gear, a spur gear, a worm gear, a planetary gear, or the like. It should also be understood that although the second power transfer mechanism 64 is illustrated as being positioned upstream relative to the first power transfer mechanism 62, the second power transfer mechanism 62 can also be positioned downstream of the first power transfer mechanism 62.

In an embodiment, the second drive shaft 54 extends laterally within the housing 22, wherein the opposing distal ends of the second drive shaft 54 are operatively connected to an inner surface of the housing 22 in a manner that allows the second drive shaft 54 is rotatable relative to the housing 22, as shown in FIGS. 1A-5B. The second drive shaft 54 extends the entire width of the housing 22, between both side walls thereof, and passes through the gear housing 30. The gear housing 30 includes a pair of bearings 58 positioned within bosses 60, wherein the bosses 60 provide the openings through which the second drive shaft 54 enters the gear housing 30. In an embodiment in which the lateral drive shaft 54 is formed of two separate shafts that extend into the gear housing 30 from the opposing side walls of the housing 22, a bearing 58 positioned within a corresponding boss 60 is located adjacent to the distal end of each lateral drive shaft within the gear housing 30. A similar rotatable bearing is positioned adjacent to the inner surface of both opposing side walls of the housing 22 to receive a distal end of the second drive shaft 54, thereby allowing the second drive shaft 54 to rotate relative to the housing 22.

The second drive shaft 54 includes a third power transfer mechanism 66 operatively connected thereto, as shown in FIGS. 5A-5B. In an embodiment, the third power transfer mechanism 66 is a worm gear that is configured to correspond to and mesh with the second power transfer mechanism 62 of the first drive shaft 28 that is also a worm gear. It should be understood by one having ordinary skill in the art that the third power transfer mechanism 66 can be formed as any other type of mechanical component capable of transferring rotational power and rotation between the first and second drive shafts 28, 54 such as a spiral gear, a bevel gear, a spur gear, a worm gear, a planetary gear, or the like. In the illustrated embodiment, rotational power is transferred directly between the first drive shaft 28 to the second drive shaft 54 by way of the meshing engagement between the second and third power transfer mechanisms 64, 66. However, it should be understood by one having ordinary skill in the art that the second and third power transfer mechanisms 64, 66 may be different types of mechanical components and an intermediate mechanism may be positioned therebetween to both mesh with each power transfer mechanism as well as provide for an indirect transfer of rotational power and rotation between the first and second drive shafts 28, 54. In an embodiment, the worm gear of the second power transfer mechanism 64 and the worm gear of the third power transfer mechanism 66 are configured such that the first and second drive shafts 28, 54 rotate at substantially the same rotational velocity. It should be understood by one having ordinary skill in the art that the second and third power transfer mechanisms 64, 66 can also be configured such that the first drive shaft 28 rotates at a faster rotational velocity than the second drive shaft 54 or the first drive shaft 28 rotates at slower rotational velocity than the second drive shaft 54. In the illustrated embodiments, because the second drive shaft 54 is operatively driven by the first drive shaft 28, rotation of the second drive shaft 54—and the third stage assembly 36 attached thereto—is dependent upon the rotation of the first drive shaft 28. In other embodiments, the second drive shaft 54 is independently rotatable relative to the first drive shaft 28.

As shown in FIGS. 1A-3, 4A-4B, and 5A-5B, a single second drive shaft 54 is rotatably attached to each of the opposing side walls of the housing 22 by way of a bearing 58 positioned between a distal end of the second drive shaft 54 and the housing 22, and a portion of the second drive shaft 54 is disposed within the gear housing 30. The second drive shaft 54 is oriented at an angle relative to the first drive shaft 28. In an embodiment, the second drive shaft 54 is oriented in a substantially perpendicular or transverse manner relative to the first drive shaft 28. In another embodiment, the second drive shaft 54 is formed of two separate lateral drive shafts, wherein each lateral drive shaft extends between the housing 22 and the gear housing 30. In some of these embodiments, the lateral drive shafts can be oriented at an angle relative to said first drive shaft, wherein the angle can be between about 45° and 90°. In yet another embodiment, the second drive shaft 54 is formed of separate lateral drive shafts that extend from each of the opposing side walls of the housing 22 generally toward the gear housing 28 without extending the entire distance between the side wall of the housing 22 and the gear housing 28. These lateral drive shafts are powered separately from the first drive shaft 28.

In other embodiments in which the second drive shaft 54 is formed of separate lateral drive shafts that only extend between the housing 22 and the gear housing 30, each of the separate lateral drive shafts include a power transfer mechanism operatively connected thereto (such as a bevel gear or the like) which allows for the transfer of rotational power and rotation from the first drive shaft 28 to each of the separate lateral drive shafts.

In an embodiment, the third drive shaft 56 is oriented longitudinally within the gear housing 30 and extends forward from the gear housing 30 in a generally parallel manner relative to the first drive shaft 28, as shown in FIGS. 3A-3B, 4, and 5A-5B. The third drive shaft 56 extends from the gear housing 30 in a cantilevered manner such that the bearings 58 and bosses 60 of the housing provide the structural support for the third drive shaft 56. A first bearing 58 is located within a boss 60 of the gear housing 30 and is positioned adjacent to the distal end of the third drive shaft 56 located within the gear housing 30. A second bearing 58 is located within a boss 60 of the gear housing 30 and is positioned adjacent to the portion of the third drive shaft 56 that exits the gear housing 30. The third drive shaft 56 includes a fourth power transfer mechanism 68 operatively connected thereto. The fourth power transfer mechanism 68 can be fixedly connected to the third drive shaft 56, removably connected to the third drive shaft 56, or integrally formed with the third drive shaft 56. In the illustrated embodiment, the fourth power transfer mechanism 68 is a pinion gear fixedly attached to the third drive shaft 56, wherein the pinion gear of the fourth power transfer mechanism 68 is meshingly engaged with the corresponding pinion gear of the first power transfer mechanism 62. In an embodiment, the number of gear teeth of both pinion gears is the same so that the first drive shaft 28 rotates at substantially the same rotational velocity as third drive shaft 56. In another embodiment, the number of gear teeth of the fourth power transfer mechanism 68 on the third drive shaft is greater than the number of gear teeth on the first power transfer mechanism 62 such that the first drive shaft 28 rotates at a slower rotational velocity than the third drive shaft 56. In still another embodiment, the number of gear teeth of the fourth power transfer mechanism 68 on the third drive shaft is less than the number of gear teeth on the first power transfer mechanism 62 such that the first drive shaft 28 rotates at a faster rotational velocity than the third drive shaft 56. It should be understood by one having ordinary skill in the art that an intermediate gear or gear set may be positioned between the first and fourth power transfer mechanisms 62, 68, wherein the intermediate gear or gear set may act as a reduction gear or a multiplier gear.

A third stage assembly 36 is operatively connected to the second drive shaft 56, as shown in FIGS. 3A-3B and 4. The third stage assembly 36 rotates about an axis defined by the second drive shaft 56, wherein the axis about which the third stage assembly 36 rotates is different than the axis about which the first and second stage assemblies 32, 34. The third stage assembly 36 is configured to push or otherwise move snow and ice axially with respect to the second drive shaft 54, which is laterally within the housing 22. The third stage assembly 36 is configured to include snow-moving elements positioned adjacent to both lateral sides of the gear housing 30 so that the snow is moved or pushed toward the gear housing 30 or the fore/aft centerline of the housing 22. In the illustrated exemplary embodiment, the third stage assembly 36 is formed of a pair of augers 48, wherein the augers 48 are positioned on the second drive shaft 56 between the gear housing 30 and the inner surface of the side walls of the housing 22 such that the augers 48 are located adjacent to opposing sides of the gear housing 30. In other words, one auger 48 is positioned on the second drive shaft 56 between the right lateral side of the gear housing 30 and the housing 22, and the other auger 48 is positioned on the second drive shaft 56 between the left lateral side of the gear housing 30 and the housing 22. The augers 48 are removably connected to the second drive shaft 56 by way of a connecting mechanism such as a nut-and-bolt, cotter pin, or the like. In another embodiment, the third stage assembly 36 includes a pair of augers 48 positioned between the gear housing 30 and one side wall of the housing 22 as well as another pair of augers 48 positioned between the gear housing 30 and the opposing side wall of the housing 22. It should be understood by one having ordinary skill in the art that the third stage assembly 36 can include any number of augers 48 positioned along the second drive shaft 56, and with any number of augers 48 located on each side of the gear housing 30. In some embodiments, the third stage assembly 36 includes all augers 48 that drive, push, or otherwise move snow laterally within the housing 22 toward the gear housing 30 and the centerline of the snow thrower 10. In another embodiment, the third stage assembly 36 includes at least one auger positioned adjacent to each lateral side of the gear housing as well as at least one other rotatable element paired with each lateral side of the second drive shaft 56. The other rotatable element may be formed as a brush, a paddle, or any other mechanism capable of assisting the augers 48 in moving the accumulated snow and/or ice toward the gear housing 30. The augers 48 of the third stage assembly 36 can be the same type or construction as the augers 48 used for any other stage assembly, or they can be formed differently. The augers 48 of the third stage assembly 36 rotate in response to rotation of the second drive shaft 54, and rotation of the augers 48 acts to both contact and cut up accumulated snow and ice as well as move and push the snow and ice within the housing 22 toward the gear housing 30.

A fourth stage assembly 38 is operatively connected to the third drive shaft 56, as shown in FIGS. 3A-3B and 4. The fourth stage assembly 38 rotates about the axis defined by the third drive shaft 56. In an embodiment, the axis defined by the third drive shaft 56 is oriented generally parallel to, but not collinear with, the axis of the first drive shaft 28 about which the first and second stage assemblies 32, 34 rotate. The fourth stage assembly 38 is configured to push or otherwise move snow and ice axially with respect to the third drive shaft 56, which is longitudinally within the housing 22. The fourth stage assembly 38 is configured to include at least one snow-moving element positioned adjacent to forwardly-directed wall of the gear housing 30 and is configured to move snow is toward the gear housing 30 generally along the fore/aft centerline of the housing 22. In the illustrated exemplary embodiment, the fourth stage assembly 38 is formed of an auger 48 removably attached to the third drive shaft 56, wherein the auger 48 positioned on the third drive shaft 58 forward, or upstream, of the gear housing 30. The auger 48 of the fourth stage assembly 38 is held in a cantilevered manner. It should be understood by one having ordinary skill in the art that although the fourth stage assembly 38 is shown as including only one auger 48, any number of augers 48 or other mechanism for breaking up accumulated snow and ice and moving or pushing the snow downstream in a rearward direction toward the second and first stage assemblies 34, 32. The fourth stage assembly 38 is positioned on the third drive shaft 56 such that the fourth stage assembly 38 is located longitudinally forward of the third stage assembly 36, as shown in FIG. 3B. In another embodiment, the fourth stage assembly 38 is positioned on the third drive shaft 56 such that the fourth stage assembly 38 is generally aligned with the third stage assembly 36 in the longitudinal direction, even though the third and fourth stage assemblies 36, 38 rotate about substantially perpendicular axes.

In the illustrated embodiments, because the third drive shaft 56 is operatively driven by the first drive shaft 28, rotation of the third drive shaft 56—and the fourth stage assembly 38 attached thereto—is dependent upon the rotation of the first drive shaft 28. However, because the third drive shaft 56 may not be directly connected to the second drive shaft 54, the third drive shaft 56—and the fourth stage assembly 38 attached thereto—can be independently rotatable relative to the second drive shaft 54—and the third stage assembly 36 attached thereto. In an embodiment, the third drive shaft 56 rotates separately from the first drive shaft 28 such that the fourth stage assembly 38 rotates separately from the second stage assembly 36.

In an embodiment, the fourth stage assembly 38 is configured to rotate at the same rotational velocity as the third stage assembly 36. In another embodiment, the fourth stage assembly 38 is configured to rotate at a different rotational velocity relative to the third stage assembly 36. The tip speed of the auger(s) 48 of the fourth stage assembly 38 can rotate at a different speed than the augers 48 of the third stage assembly 36 to compensate for travel speed of the snow thrower 10. The slower tip speed of the augers 48 of the third stage assembly 38 compared to the augers 48 of the fourth stage assembly 38 aids in the snow collection and transfer of the snow toward the gear housing 30 and centerline of the snow thrower 10. It should be understood by one having ordinary skill in the art that the auger(s) 48 of the fourth stage assembly 38 may also be configured to rotate slower than the augers 48 of the third stage assembly 36.

As shown in FIG. 5B, the second drive shaft 54 is positioned below the first drive shaft 28, and the third drive shaft 56 is positioned below the second drive shaft 28. As such, the fourth stage assembly 38 is located vertically lower than the first, second, and third stage assemblies 32, 34, 36. The result of the vertical positioning of the first, second, and third drive shafts 28, 54, 56 is that the auger 48 of the fourth stage assembly 38 is positioned as the vertically lowest auger 28 that contacts the accumulated snow, which allows the auger 48 of the fourth stage assembly 38 to be located closest to the driveway, walkway, or surface being cleared of snow. By positioning the auger 48 of the fourth stage assembly 38 closer to the surface being cleared by the snow thrower 10, more accumulated snow and ice can be cleared by the snow thrower 10 per pass, which reduces the number of times that the snow thrower 10 needs to go over the same area to ensure the maximum amount of snow removal. The lowered auger 48 of the fourth stage assembly 38 provides improved snow removal because the lowered auger 48 is positioned closer to the terrain which allows the auger to contact the accumulated snow at a shallower depth. As such, the snow thrower 10 is more efficient at clearing snow at smaller depths of accumulation.

In an embodiment, the snow thrower 10 also includes a baffle 70 positioned within the housing 22 and attached to an inner surface of the housing 22 such that it surrounds a portion of the outlet aperture 26 that leads to the expulsion housing 29, as shown in FIGS. 1A-2 and 4. The baffle 70 is an arcuate, or curved member having a radius of curvature that is substantially the same as the radius of curvature of the outlet aperture 26. In an embodiment, the baffle 70 includes a plurality of tabs that are welded to the housing 22. In yet another embodiment, the baffle 70 is releasably connected to the housing 22 by way of bolts or other releasable mechanical connectors. In a further embodiment, the baffle 70 is integrally formed with the housing 22. The baffle 70 is configured to assist in reducing or restraining the amount of snow that is re-circulated within the housing 12 by limiting the amount of snow that slips off the tips 46 of the auger and re-enters the housing 22. The baffle 70 then directs the snow toward the impeller 40 of the first stage assembly 32 to be expelled via the chute 20. The baffle 70 can be made by any resilient material such as steel, aluminum, or any other type of metal or hard plastic that can withstand the stresses and temperature conditions of the snow thrower 10.

It should be understood by one having ordinary skill in the art that although the figures illustrate the direct meshing of corresponding gears between the first drive shaft 28 with the second and third drive shafts 54, 56, the transfer of rotational movement from the first drive shaft 28 may also be done indirectly to the second and third drive shafts 54, 56. For example, a multiplier (not shown) and/or a reducer (not shown) can be positioned between the first or second power transfer mechanism 62, 64 a corresponding power transfer mechanism on the second or third drive shaft 54, 56.

The impeller 40 and the auger 48 of the second stage assembly 34 positioned immediately adjacent thereto are oriented and timed such that they rotate at the same angular velocity, wherein as the snow slides from the end of the flight 50 of the auger 48 toward the impeller 40, the impeller 40 is positioned such that the snow enters the gap between adjacent blades 42 of the impeller 40 so that re-circulation of the snow is reduced.

In operation, the user grasps the handles 14 and powers up the power supply 12 to turn on the snow thrower. In an embodiment, the power supply 12 begins to provide rotational power to the first drive shaft 28 upon start-up. In another embodiment, the power supply 12 selectively provides rotational power to the first drive shaft 28, wherein the user determines when the rotational power generated by the power supply 12 is transferred to the first drive shaft 28. Once the power supply 12 and operatively engages the first drive shaft 28, the first drive shaft 28 begins to rotate. Rotation of the first drive shaft 28 causes the first and second stage assemblies 32, 34 to simultaneously rotate in the same manner as the first drive shaft 28.

The meshing engagement between the first and second power transfer mechanisms 62, 64 of the first drive shaft 28 with the third and fourth power transfer mechanisms 66, 68 of the second and third drive shafts 54, 56, respectively, causes the second and third drive shafts 54, 56 to rotate. Rotation of the second drive shaft 54 causes the third stage assembly 36 to rotate in a similar manner. Likewise, rotation of the third drive shaft 56 causes the fourth stage assembly 38 to rotate in a similar manner. Thus, once the power supply 12 begins to transfer rotation to the first drive shaft 28, the rotation of the first drive shaft 28 is then transferred to the second and third drive shafts 54. 56. When the first, second, and third drive shafts 28, 54, 56 are rotating, the first, second, third, and fourth stage assemblies 32, 34, 36, and 38 are also rotating as a result of being operatively connected to one of the drive shafts.

After the first, second, third, and fourth stage assemblies 32, 34, 36, and 38 have begun rotating, the snow thrower 10 can begin to remove accumulated snow and ice from a driveway, sidewalk, or the like. As the snow thrower 10 is moved into contact with the snow and ice, rotation of the fourth stage assembly 38 breaks up the accumulated snow and ice and begins pushing the snow and ice downstream, or longitudinally rearward, toward the first and second stage assemblies 32, 34. At the same time, the third stage assembly 38 also breaks up the accumulated snow and ice and beings pushing the snow and ice axially along the second drive shaft 54 toward the gear housing 30 in an outside-in manner in which the snow is pushed by the third stage assembly 38 from the side walls of the housing 22 toward the longitudinal centerline of the housing 22. As the snow is pushed and moved toward the center of the housing 22 by the third and fourth stage assemblies 36, 38, rotation of the second stage assembly 34 moves the snow and ice downstream, or longitudinally rearward, toward the first stage assembly 32. The second stage assembly 34 pushes the snow and ice rearwardly through the outlet aperture 26 of the housing 22 and into the expulsion housing 29 in which the first stage assembly 32 is located. Rotation of the first stage assembly 32 within the expulsion housing 29 drives the snow and ice radially outward such that the snow and ice is expelled from the expulsion housing 29 by way of the chute 20, and the snow and ice is thrown in a user-selected direction away from snow thrower 10.

In an embodiment, the multiple-stage snow thrower 10 includes an impeller speed adjustment assembly 200, as shown in FIGS. 1A-1B and 6A-6B. The impeller speed adjustment assembly 200 is operatively connected to the impeller 40 and is configured to allow the operator to selectively increase, or otherwise change the rotational velocity, or speed, of the impeller 40 located within the housing 22. By selectively increasing, or otherwise changing, the speed of the impeller 40, the operator can better control the distance that the snow is expelled or thrown from the snow thrower 10. The snow thrower 10 has a first, "normal" speed of the impeller 40, and the impeller speed adjustment assembly 200 provides at least one additional speed of the impeller 40. In an embodiment, the impeller speed adjustment assembly 200 includes an operator control mechanism 210, a connection assembly 212, and an adjustment assembly 214. The operator control mechanism 210 allows the operator to selectively switch—or otherwise change—the rotational speed of the impeller 40 between at least two speeds. The adjustment assembly 214 is configured to adjust the speed of the impeller 40. The connection assembly 212 operatively connects the operator control mechanism 210 to the adjustment assembly 214.

Figure 6A:
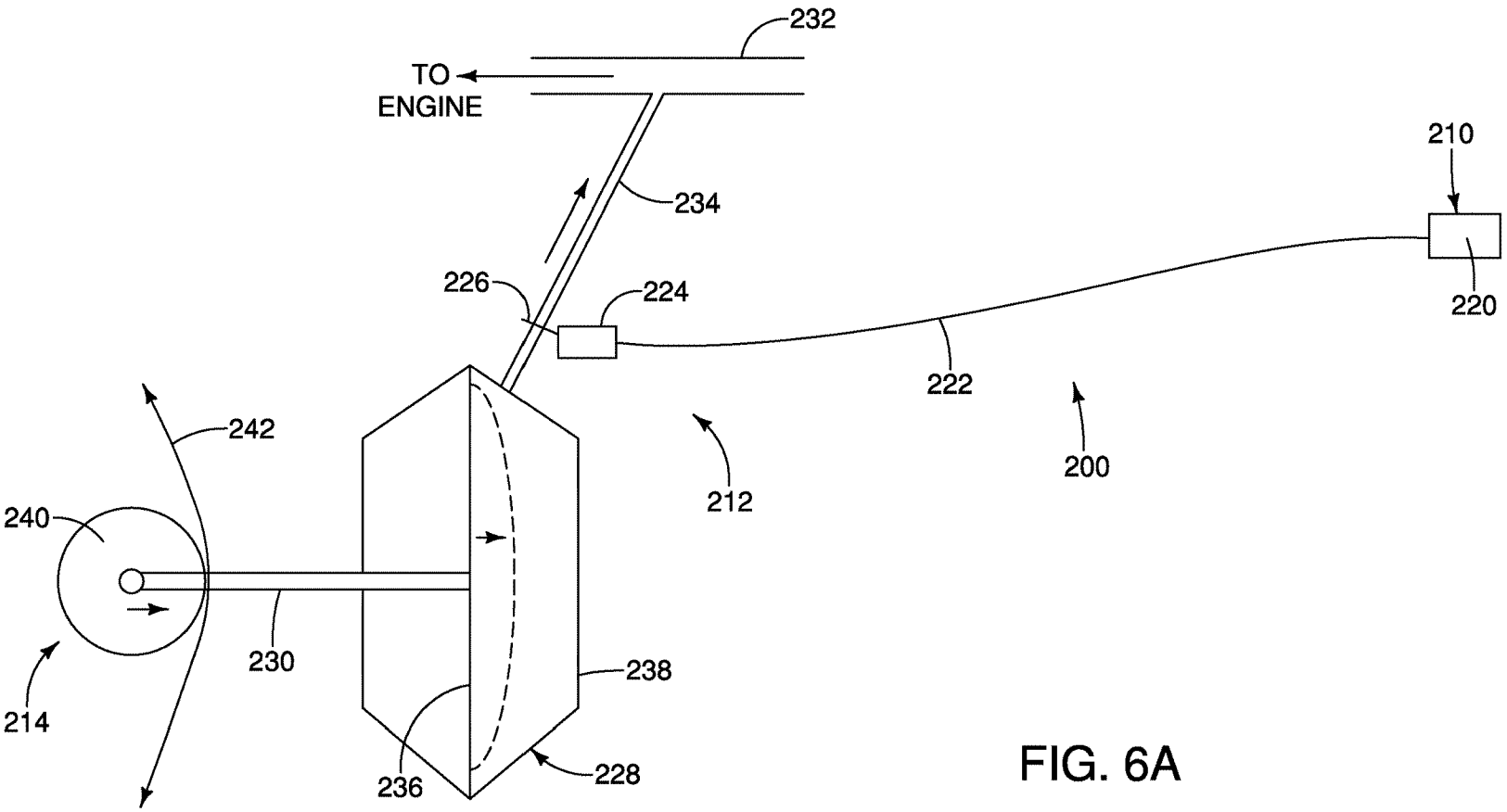
FIG. 6A is an embodiment of an impeller speed adjustment assembly.

In the embodiment of the impeller speed adjustment assembly 200 illustrated in FIGS. 1A-1B and 6A, the operator control mechanism 210 is formed as a lever 220 that is actuated by the operator. In the illustrated embodiment, the lever 220 is positioned adjacent to at least one handle 14, which allows the operator to actuate the lever 220 during operation of the snow thrower 10 while holding the handle 14. In other embodiments, the control mechanism 210 is positioned away from the handles 14, such as the instrument panel extending between the handles or on the engine housing. The lever 220 being positioned adjacent to a handle 14 allows an operator to select a more temporary change in the impeller rotational speed by holding down the lever 220 and releasing the lever 220 once the need for the change in rotational speed is no longer needed. Locating the control mechanism 210 away from the handle provides a more long-term change in the rotational speed of the impeller. The illustrated embodiment of the lever 220, as shown in FIG. 1A, includes a pair of arms oriented at an angle relative to each other, wherein the operator presses one of the arms toward the handle 14 to rotatably actuate the lever 220. The lever 220 is actuatable or rotatable between a first position in which the impeller 40 rotates at a first speed and a second position in which the impeller 40 rotates at a second speed. The lever 220 remains in, or is biased toward, the first position, or the "normal" position, wherein the impeller 40 rotates at a pre-determined rotation velocity until the operator actuates the lever 220 by actuating the lever 220 from the first position to the second position. When the lever 220 is actuated to the second position, or the "boost" position, the impeller 40 rotates at a different speed as long as the operator continually actuates—or maintains—the lever 220 in the second position. It should be understood by one having ordinary skill in the art that the operator control mechanism 210 can include multiple actuatable positions to operatively switch the impeller 40 between a plurality of rotational velocities. In other embodiments, the operator control mechanism 210 is actuatable to provide at least one operator-selected alternative impeller 40 speed without continuous actuation (or manual depression) of the operator control mechanism 210.

In other embodiments, the operator control mechanism 210 is formed as a rotatable dial (not shown) having a plurality of pre-determined, or indexed, positions, wherein the dial is selectively rotatable between the pre-determined positions to change the rotational speed of the impeller 40. In another embodiment, the operator control mechanism 210 is formed as a rotatable dial (not shown) having an infinite number of operative positions, wherein the dial allows the operator to adjust the rotational velocity of the impeller 40 between an infinite number of rotational velocities. These dials allow the operator to passively adjust or change the rotational velocity of the impeller 40 without continuous input such as continually depressing or actuating a lever. In another embodiment, the operator control mechanism 210 is a switch (not shown) having a plurality of operative positions, wherein actuation of the switch between each operative position changes the rotational velocity of the impeller 40. In another embodiment, the operator control mechanism 210 is a push-button that is depressible to switch the impeller 40 between different rotational velocities. It should be understood by one having ordinary skill that the operator control mechanism 210 can be any mechanical, electrical, or electro-mechanical mechanism that allows an operator to adjust the rotational velocity of the impeller 40 before or during operation of the snow thrower 10. The operator control mechanism 210 can be configured to require active actuation (such as requiring continuous grasping or depression of a lever or the like to maintain the impeller 40 in a changed rotational velocity) or passive actuation (such as a single-operation switch or rotatable dial) by the operator.

The operator control mechanism 210 is operatively connected to the adjustment assembly 214 by way of the connection assembly 212, as shown in FIG. 6A. In the illustrated embodiment, the connection assembly 212 includes a cable 222, a solenoid valve 224, a valve 226, a diaphragm valve 228, and a rod 230. In an embodiment, the cable 222 is a Bowden cable. In another embodiment, the cable 222 is an electrical cable. It should be understood by one having ordinary skill in the art that the cable 222 can provide a mechanical connection, an electrical connection, or any other type of connection with the operator control mechanism 210 to transfer actuation of the operator control mechanism 210 therethrough. In other embodiments, the connection assembly 212 is formed as a wireless controller, such as a wireless signal being transferred from the control mechanism 210 to the adjustment assembly 214 in response to actuation of the control mechanism 210.

One end of the cable 222 is connected to the operator control mechanism 210, and the opposing end of the cable 222 is connected to a solenoid valve 224, wherein actuation of the operator control mechanism 210 is transferred to the solenoid valve 224 by way of the cable 222, as shown in FIG. 6A. The solenoid valve 224 is configured to open and close a valve 226 positioned within a tubular pathway 234 that extends between the diaphragm valve 228 and the air inlet 232. When the operator control mechanism 210 is in the first (normal) position, the valve 226 within the tubular pathway 234 is in a closed position. When the operator control mechanism 210 is actuated or otherwise moved to a second (boost) position, the valve 226 within the tubular pathway 234 is in an open position. The valve 226 positioned within the tubular pathway 234 may be formed as a butterfly valve, a gate valve, a control valve, a ball valve, or any other valve sufficient to fully close and at least partially open the tubular pathway 234 for controlling the flow of air therewithin. In another embodiment, the cable 222 is connected directly to the valve 226 positioned within the tubular pathway 234 in order to actuate the valve 226. In another embodiment, the solenoid valve 224 and the valve 226 within the tubular pathway 234 are formed as a unitary member. In another embodiment, the valve 226 within the tubular pathway 234 can be movable between a fully opened position, a fully closed position, and at least one position therebetween.

In the exemplary embodiment illustrated in FIG. 6A, the tubular pathway 234 extends between a diaphragm valve 228 and the air inlet 232 for the power supply 12. When the valve 226 positioned within the tubular pathway 234 is open and the power supply 12 is in an on or active mode, a suction is created within the air inlet 232 that pulls ambient air through the air inlet 232 to be used by the power supply 12, as shown by the arrow in FIG. 6A. As such, when the power supply 12 is active and the valve 226 within the tubular pathway 234 is likewise in an open position, the movement or draw of air within the tubular pathway 226 toward the power supply 12 also creates a negative pressure differential—or vacuum—within the tubular pathway 234. When the vacuum in the tubular pathway 234 is created, the negative pressure differential likewise causes a suction of air out of the diaphragm valve 228, as shown by the arrows of airflow within the tubular pathway 234 and movement of the diaphragm 236 in FIG. 6A.

As shown in FIG. 6A, the connection assembly 212 includes a diaphragm valve 228. The diaphragm valve 228 includes a shell 238 having a flexible diaphragm 236 positioned within the shell 238, wherein the diaphragm divides the volume within the shell 238 into two distinct and separate volumes on opposing sides of the diaphragm. The tubular pathway 234 is attached to the shell 238 such that it is in fluid communication with one of the volumes within the shell 238. As the vacuum is created within the tubular pathway 234 when the valve 226 is opened and the power supply 232 is active, air is withdrawn from the volume within the shell 238 through the tubular pathway 234. As the vacuum removes air from one side of the diaphragm 236, a pressure differential is created across the diaphragm 236 which results in deformation of the diaphragm 236 toward the volume experiencing the vacuum, as shown by the dashed line representing the deformed diaphragm 236 in FIG. 6A.

The connection assembly 212 further includes a rod 230 having one end attached to the diaphragm 236 within the diaphragm valve 228 and an opposing end extending out from the shell 238, as shown in FIG. 6A. The rod 230 is a substantially rigid member that is mechanically attached to the diaphragm 236 and is configured to allow the diaphragm 236 to move and flex in response to the pressure differential within the shell 238 of the diaphragm valve 228. The rod 230 is operatively connected to the shell 238 such that when the diaphragm 236 flexes, the rod 230 is allowed to move relative to the shell 238. In an embodiment, the rod 230 extends through an aperture in the shell 238. The distal end of the rod 230 that extends from the diaphragm valve 228 is operatively connected to an idler pulley 240 of the adjustment assembly 214. In operation, as the diaphragm 236 of the diaphragm valve 228 flexes, the rod 230 is pulled (axially) in the direction of movement of the diaphragm 236. As the rod 230 moves axially, the rod 230 moves the idler pulley 240 into engagement with a belt 242, thereby engaging the belt 242 and idler pulley 240 of the adjustment assembly, as will be described below.

Figure 6B:
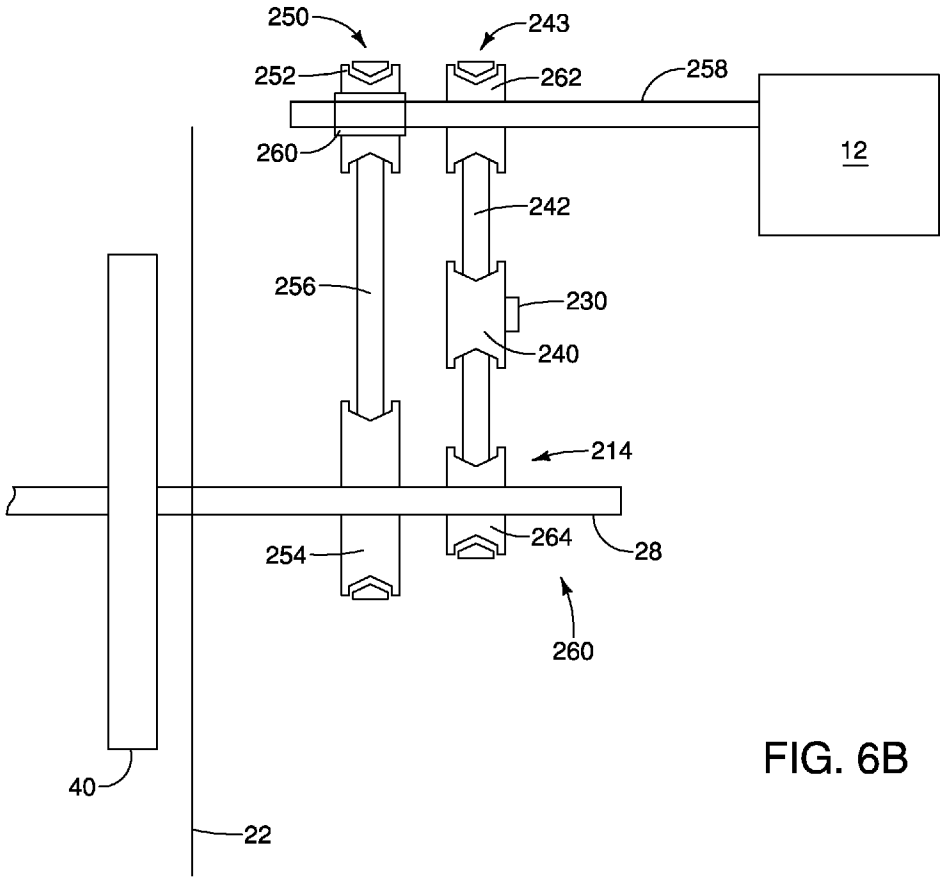
FIG. 6B is an embodiment of the drive trains for a snow thrower.

FIG. 6B illustrates the first drive train 250 for driving the first drive shaft 28 and each of the stage assemblies operatively connected thereto. The first drive train 250 includes a first drive pulley 252, a first driven pulley 254, and a continuous first belt 256 extending between the first drive pulley 252 and the first driven pulley 254. The first drive pulley 252 is attached to the crankshaft 258 that extends from the power supply 12. The crankshaft 258 is illustrated as extending from the power supply 12, but it should be understood by one having ordinary skill in the art that the crankshaft 258 to which the first drive pulley 252 is attached may be directly or indirectly driven by the rotational shaft extending from the power supply 12 but it is not necessary to attach the first drive pulley 252 to the crankshaft that extends from the power supply 12. In some embodiments, the first drive pulley 252 is attached directly to the crankshaft 258 in a fixed manner to transfer rotation from the crankshaft 258 to the first drive pulley 252 such that the first drive pulley 252 rotates simultaneously with the crankshaft 258. The first drive train 250 provides a first drive ratio between the first drive pulley 252 and the first driven pulley 254 that produces a first impeller speed by transferring the rotation of the crankshaft 258 to the first drive shaft 28 and impeller 40.

In some embodiments of the snow thrower 10 having the impeller speed adjustment assembly 200 (shown in FIG. 6B), the first drive pulley 254 is attached to the crankshaft 258 by way of a one-way bearing 260. The one-way bearing 260 provides a fixed connection with the crankshaft 258 when the one-way bearing 260 is being driven in the direction of rotation of the crankshaft 258, but is allowed to "free-wheel" or otherwise if not driven by the crankshaft 258 in instances when the first drive train 250 is effectively driven by the first drive shaft 28, as will be explained below, wherein the first drive pulley 252 rotates in the same direction as the crankshaft 258 but at a rotational speed that is faster than the rotational speed of the crankshaft 258. The first belt 256 provides a continuous connection between the first drive pulley 252 and the first driven pulley 254.

FIG. 6B illustrates an exemplary embodiment of the adjustment assembly 214 of the impeller speed adjustment assembly 200. The adjustment assembly 214 includes an idler pulley 240 and a second drive train 243 which includes a second belt 242, a second drive pulley 262, and a second driven pulley 264. As explained above, the idler pulley 240 of the adjustment assembly 214 is operatively connected to the rod 230 of the connection assembly 212. The idler pulley 240 is a pulley that is selectively engaged with the second belt 242, wherein the idler pulley 240 is movable in response to actuation of the operator control mechanism 210. When the operator control mechanism 210 is actuated, the idler pulley 240 moves in a translating motion in order to engage with and tighten the second belt 242. The tightened second belt 242 allows the rotation of the second drive pulley 262 to be transferred to the second driven pulley 264 and the first drive shaft 28.

As shown in FIG. 6B, the second belt 242 extends around the second drive pulley 262, the second driven pulley 264, and the idler pulley 240. When the impeller speed adjustment assembly 200 is in an inactive mode, the idler pulley 240 is positioned such that the second belt 242 is slack and the idler pulley 240 is not engaged with the second belt 242. Even though there may be contact between the idler pulley 240 and the second belt 242 when the idler pulley 240 is in the disengaged position, when in this position, the idler pulley 240 is not engaged enough to allow the transfer of rotation from the second drive pulley 262 to the second driven pulley 264. When the impeller speed adjustment assembly 200 is in an active mode, the idler pulley 240 is moved to a position such that the second belt 242 is tightened and the idler pulley 240 is engaged with the second belt 242 to allow the transfer of rotation from the second drive pulley 262 to the second driven pulley 264. In an embodiment, the second belt 242 is a V-shaped belt that is configured to be received in the second drive and driven pulleys 262, 264, which have a corresponding V-shaped notch. In other embodiments, the second belt 242 can be formed of any shape sufficient to engage a correspondingly-shaped groove formed in the second drive and driven pulleys 262, 264. In other embodiments, the second belt 242 can be formed as a chain or other mechanism that operatively connects the second drive and driven pulleys 262, 264 as well as selectively engaging the idler pulley 240 to allow the transfer of rotation from the second drive pulley 262 to the second driven pulley 264. In the illustrated embodiment, the second belt 242 is configured to continually engage the second drive and driven pulleys 262, 264, but the second belt 242 is only taught enough to transfer rotation from the second drive pulley 262 to the second driven pulley 264 when the operator control mechanism 210 of the impeller speed adjustment assembly 200 is actuated such that the idler pulley 240 tightens the second belt 242.

The second drive pulley 262 of the second drive train 243 is operatively connected to the crankshaft 258, as shown in FIG. 6B. The second drive pulley 262 is fixedly attached to the crankshaft 258 so that the second drive pulley 262 rotates in direct response to rotation of the crankshaft 258, and the second drive pulley 262 rotates with the crankshaft 258. In the illustrated embodiment, the second drive pulley 262 is substantially the same size (diameter) as the first drive pulley 252 so that the rotational output from the crankshaft 258 is substantially the same via both the first and second drive pulleys 252, 262. In other embodiments, the second drive pulley 262 is formed as a different size relative to the first drive pulley 252, wherein the second drive pulley 262 can be formed as having a smaller or larger diameter relative to the first drive pulley 252. The second drive pulley 262 includes a V-shaped groove to correspond to the V-shaped second belt 242 received therein, but it should be understood by one having ordinary skill in the art that the groove in the second drive pulley 262 can be formed of any shape.

As shown in FIG. 6B, the second driven pulley 262 is fixedly attached to the first drive shaft 28 such that the second driven pulley 262 is configured to cause the first drive shaft 28 to rotate in response to rotation of the second driven pulley 262. The groove of the second driven pulley 262 is formed as the same shape as the second drive pulley 262 and the idler pulley 240. The second driven pulley 262 is driven by the second drive pulley 262 only when the operator control mechanism 210 is actuated and the idler pulley 240 is moved to an engaged position which causes the second belt 242 to be tightened. When the second belt 242 is tightened, the idler pulley 240 engages the second belt 242, the second drive pulley 262, and the second driven pulley 264. In the illustrated embodiment, the second driven pulley 264 is the same size (diameter) as the second drive pulley 262 such that the second drive pulley 262 rotates at the same rotational speed as the second driven pulley 264 to produce a drive ratio between the second drive and driven pulleys 262, 264 of about 1:1. In other embodiments, the second drive pulley 262 is a larger size (diameter) than the second driven pulley 264 such that the second driven pulley 264 rotates faster than the second drive pulley 262 to produce a drive ratio between the second drive pulley 262 and the second driven pulley 264 is greater than or equal to about 2:1. In some embodiments, the drive ratio between the second drive pulley 262 and the second driven pulley 264 is about 4:1. In other embodiments, the drive ratio between the second drive pulley 262 and the second driven pulley 264 is about 8:1. In still another embodiment, the second driven pulley 264 is a larger size (diameter) than the second drive pulley 262 such that the second driven pulley 264 rotates faster than the second drive pulley 262 to produce a drive ratio between the second drive pulley 262 and the second driven pulley 264 is less than about 1:1. The drive ratio generated by the second drive train 243 produces a second impeller (and first drive shaft) speed, wherein the second impeller (and drive shaft) speed generated by the second drive train 243 is different than the first impeller (and first drive shaft) speed generated by the first drive train 250. In the embodiment illustrated in FIG. 6B, the second drive train 243 is configured to rotate the first drive shaft 28 at a greater rotational velocity than the first drive train 250, thereby providing a "boost" to the rotational velocity of the impeller 40.

The second drive train 243 is configured to provide a drive ratio that produces a second impeller speed in which the first drive shaft 28 is rotated at a faster rotational velocity than the drive ratio that produces a first impeller speed that is provided by the first drive train 250. This increase in impeller speed due to the engagement of the second drive train 243 allows the impeller speed adjustment assembly 200 to provide at least one alternative rotational velocity than that provided by the first drive train 250. Although the description provided below is in reference to a "boost"—or increase in the rotational velocity—of the first drive shaft 28 and impeller 40 as a result of engagement of the second drive train 243, it should be understood by one having ordinary skill in the art that the engagement of the second drive train 243 can provide either an increase in the rotational velocity, a decrease in the rotational velocity, or both an increase and a decrease in rotational velocity of the first drive shaft 28 and the impeller 40 (for multi-positioned control mechanisms 210). In the embodiment illustrated in FIG. 6B, the impeller speed adjustment assembly 200 includes only one secondary drive train selectively engageable by the control mechanism 210 to provide a single alternative speed or rotational velocity of the first drive shaft 28 and impeller 40 relative to the speed or rotational velocity provided by the first drive train 250. In other embodiments, the impeller speed adjustment assembly 200 includes components to provide for more than one alternative speed or rotational velocity of the first drive shaft 28 and impeller 40 relative to the speed or rotational velocity provided by the first drive train 250. For example, the second drive train 243 may be formed as a continuous variable transmission (CVT) that provides an infinite number of alternative speeds for the first drive shaft 28 and the impeller 40.

The second drive train 243 is selectively switchable between an active state and an inactive state, wherein actuation of the operator control mechanism 210 by the operator switches the second drive train 243 from an inactive state to an active state. When in an inactive state, the second drive train 243 is not engaged so there is no transfer of rotation between the crankshaft 258 and the first drive shaft 28 by way of the second drive train 243. Instead, the transfer of rotation between the crankshaft 258 and the first drive shaft 28 is by way of the first drive train 250. When in an active state (when the operator control mechanism 210 is actuated to a boost position), the second drive train 243 is engaged by the idler pulley 240 and the drive ratio of the second drive train 243 causes the first drive shaft 28 and impeller 40 rotate at a faster rotational velocity than the drive ratio of the first drive train 250. Because the second drive train 243 produces a faster rotational velocity of the first drive shaft 28, the one-way bearing 260 allows the first drive pulley 252 to freely spin about the crankshaft 258 such that the first drive pulley 252 is driven by the rotation of the first driven pulley 254 and the first drive shaft 28. As such, when the second drive train 243 is engaged, the second drive train 243 drives both the first drive shaft 28 and impeller 40 as well as the first drive train 250. In another embodiment, the one-way bearing 260 can be used to operatively connect the first driven pulley 254 to the first drive shaft 28. When the operator control mechanism 210 is actuated, the first drive train 250 does not transfer rotation from the crankshaft 258 to the first drive shaft 28, even though the first drive train 250 rotates.

When the operator control mechanism 210 is in the inactive position (a first, normal operative position) and the idler pulley 240 is positioned in the disengaged position, the first drive train 250 is configured to transfer the rotation from the crankshaft 258 to the first drive shaft 28, thereby causing the first drive shaft 28 and the impeller 40 to rotate at a first speed. When the operator control mechanism 210 is in the active position (a second, boost operative position) and the idler pulley 240 is positioned in the engaged position, the second drive train 243 transfers rotation from the crankshaft 258 to the first drive shaft 28, thereby causing the first drive shaft 28 and the impeller 40 to rotate at a second speed. In an embodiment, the second speed of the first drive shaft 28 and the impeller 40 when the operator control mechanism 210 is in the boost operative position is greater than the first speed of the first drive shaft 28 and the impeller 40 when the operator control mechanism 210 is in the normal operative position.

In an embodiment, when the operator control mechanism 210 is actuated and in the boost operative position, the drive ratio of the second drive train 243 of the impeller speed adjustment assembly 200 causes the first drive shaft 28 and impeller 40 to rotate at a faster rotational velocity than the drive ratio of the first drive train 250. In other embodiments, the operator can selectively actuate the operator control mechanism 210 between multiple operative positions such that each of the drive ratios generated by the adjustment assembly 214 is different than the drive ratio generated by the first drive train 250. In another embodiment, the snow thrower 10 includes only a single drive train that is capable of providing a plurality of operator-selectable speeds of the first drive shaft 28 and impeller 40. In still other embodiments, the adjustment assembly 200 includes a plurality of drive trains, wherein each drive train provides a different drive ratio, and each of the different drive ratios is different than the drive ratio provided by the first drive train 250.

In an alternative embodiment, the operator control mechanism 210 can be mechanically connected directly to the idler pulley 240 by way of the cable 222 such that actuation of the operator control mechanism 210 physically moves the idler pulley 240 between a first position and a second position so as to activate the second drive train 243.

The said first drive train 250 drives the first drive shaft 28 independently of the second drive train 243, and the second drive train 243 drives the first drive shaft 28 independently of the first drive train 250. In other words, only one of the drive trains conveys rotational power from the crankshaft 258 to the first drive shaft 28 at a time.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A snow thrower comprising:

an impeller operatively connected to a first drive shaft;

a first drive train extending between said first drive shaft and a crankshaft operatively connected to a power supply for selectively driving said first drive shaft at a first rotational speed in response to rotation of said crankshaft, said first drive train is in continuous engagement with said first drive shaft; and a second drive train extending between said first drive shaft and said crankshaft, wherein said second drive train selectively drives said first drive shaft at a second rotational speed;

an operator control mechanism operatively connected to said second drive train for selective engagement of only said second drive train, said operator control mechanism actuatable between a first operative position and a second operative position, wherein actuation of said operator control mechanism to said first operative position causes disengagement of said second drive train and said first drive train drives said first drive shaft at said first rotational speed, and actuation of said operator control mechanism to said second operative position causes engagement of said second drive train to drive said first drive shaft at said second rotational speed.

2. The snow thrower of claim 1, wherein said operator control mechanism is connected to an adjustment assembly operatively connected to said second drive train, wherein said adjustment assembly selectively causes the engagement of said second drive train in response to said operator control mechanism being actuated from said first operative position to said second operative position.

3. The snow thrower of claim 2, wherein said second drive train includes a belt extending between a drive pulley connected to said crankshaft and said first drive shaft, said adjustment assembly comprising an idler pulley positioned in an inactive position when said operator control mechanism is in said first operative position and said idler pulley being moved to an active position when said operator control mechanism is in said second operative position, said idler pulley engaging said belt when said idler pulley is in said active position, and said second drive train driving said first drive shaft when said idler pulley is in said active position.

4. The snow thrower of claim 3, wherein said operator control mechanism is operatively connected to a diaphragm valve, said diaphragm valve being connected to said idler pulley by a rod, wherein actuation of said operator control mechanism causes said diaphragm valve to activate, which causes said idler pulley to move from said inactive position to said active position.

5. The snow thrower of claim 1, wherein said first drive train includes a first drive pulley, a first driven pulley, and a first belt extending between said first drive pulley and said first driven pulley, said first drive pulley attached to said crankshaft and said first driven pulley attached to said first drive shaft.

6. The snow thrower of claim 5, wherein said first drive pulley is attached to said crankshaft via a one-way bearing.

7. The snow thrower of claim 1, wherein said second rotational velocity is greater than said first rotational velocity of said first drive shaft.

8. The snow thrower of claim 1, wherein said first drive train includes a first drive pulley attached to said crankshaft, a first driven pulley attached to said first drive shaft, and a first belt extending between said first drive pulley and said first driven pulley, and wherein said second drive train includes a second drive pulley attached to said crankshaft, a second driven pulley attached to said first drive shaft, and a second belt extending between said second drive pulley and said second driven pulley.

9. The snow thrower of claim 8, wherein said first drive pulley has a first diameter, said first driven pulley has a second diameter, said second drive pulley has a third diameter, and said second driven pulley has a fourth diameter.

10. The snow thrower of claim 9, wherein said first and third diameters are the same, and said second diameter is larger than said fourth diameter.

11. The snow thrower of claim 8, wherein said first drive pulley and said first driven pulley produce a first drive ratio, and said second drive pulley and said second driven pulley product a second drive ratio, wherein said second drive ratio produces a faster rotational speed of said first drive shaft than said first drive ratio.

12. The snow thrower of claim 1, wherein said first drive train drives said first drive shaft independently of said second drive train, and said second drive train drives said first drive shaft independently of said first drive train.

13. A snow thrower comprising:

an impeller operatively connected to a first drive shaft;

a first drive train extending between said first drive shaft and a crankshaft operatively connected to a power supply for selectively driving said first drive shaft at a first rotational speed in response to rotation of said crankshaft, said first drive train being in continuous engagement with said first drive shaft; and a impeller speed adjustment assembly comprising:

an operator control mechanism actuatable between a first operative position and at least one second operative positions;

a second drive train selectively engageable with said first drive shaft and operatively connected to said operator control mechanism, said second drive train extending between said first drive shaft and said crankshaft, wherein said second drive train is engaged with said first drive shaft in response to actuation of said operator control mechanism from said first operative position to one of said second operative positions, wherein said second drive train selectively drives said first drive shaft at a rotational speed different than said first rotational speed; and wherein said second drive train drives said first drive train when said second drive train is engaged.

14. The snow thrower of claim 13, wherein said second drive train drives said first drive shaft and said impeller at a faster rotational speed than said first drive train when said second drive train is engaged.

15. A snow thrower comprising:

an impeller operatively connected to a first drive shaft, said impeller is rotatably driven by rotation of said drive shaft;

a first drive train including a first drive pulley connected to a one-way bearing attached to a crankshaft extending from a power source, a first driven pulley attached to a said first drive shaft, and a first belt extending between said first drive pulley and said first driven pulley, wherein said first belt maintains said first drive train in continuous engagement with said crankshaft and said first drive shaft;

a second drive train including a second drive pulley attached to said crankshaft, a second driven pulley attached to said first drive shaft, and a second belt extending between said first drive pulley and said first driven pulley, wherein said second belt selectively engages said second drive train with said crankshaft and said first drive shaft; and an operator control mechanism operatively connected to an idler pulley that is selectively engageable with said second belt, said operator control mechanism being adjustable between a first position and a second position, wherein said idler pulley is disengaged with said second belt when said operator control mechanism is in said first position and said idler pulley is engaged with said second belt when said operator control mechanism is in said second position.

16. The snow thrower of claim 15, wherein said first drive train is driven by said second drive train when said operator control mechanism is in said second position and said idler pulley is engaged with said second belt.

17. The snow thrower of claim 15, wherein said idler pulley is connected to a diaphragm valve, wherein actuation of said operator control mechanism from said first position to said second position causes movement of said diaphragm valve to cause said idler pulley to engage said second belt.

* * * * *